US005129126A

United States Patent [19]

Huang

[11] Patent Number: 5,129,126

[45] Date of Patent: Jul. 14, 1992

[54] STRUCTURE OF FASTENING DEVICE FOR FASTENING TWO THINGS TOGETHER

[76] Inventor: Yu-Hwei Huang, No. 5, Alley 2, Lane 85, Min Tsu Road, Lu Chou Hsiang, Taipei, Taiwan

[21] Appl. No.: 708,332

[22] Filed: May 31, 1991

[51] Int. Cl.[5] ..... A45F 5/02

[52] U.S. Cl. ..... 24/3 R; 24/3 J; 24/3 K; 224/252

[58] Field of Search ..... 24/3 K, 3 R, 3 J, 343; 70/459, 456 R; 224/252

[56] References Cited

U.S. PATENT DOCUMENTS

| | | | |
|---|---|---|---|
| 780,962 | 1/1905 | Perry | 24/3 J |
| 928,006 | 7/1904 | Thomas | 24/3 K |
| 1,193,394 | 8/1916 | Smith | 24/3 K |
| 1,206,074 | 11/1916 | Zwiener et al. | 24/3 K |
| 1,489,244 | 4/1924 | Gnegy | 24/3 K |
| 1,609,347 | 12/1926 | Dee | 224/252 |
| 1,972,434 | 9/1934 | Yerk | 24/3 J |
| 2,121,440 | 6/1938 | Morrison | 24/3 K |
| 3,176,360 | 4/1965 | Pauer | 24/3 K |
| 3,267,534 | 8/1966 | Dansereau | 70/456 R |
| 4,633,691 | 1/1987 | Hardy | 224/252 |

*Primary Examiner*—Victor N. Sakran
*Attorney, Agent, or Firm*—Lowe, Price, LeBlanc & Becker

[57] ABSTRACT

A fastening device comprising a curved clamping plate bent into shape from an elongated, resilient plate which has an elongated slot longitudinally disposed at one end, a square recess spaced from said elongated slot and a hole disposed at an opposite end for holding a key chain; and a substantially Z-shaped strip spring having one end fixedly secured to said elongated slot at one end through welding joint before said elongated, resilient plate being bent into shape. The strip spring is squeezed to produce a spring force, when the curved clamping plate is clamped on an object, to rub said object against the square recess so as to firmly retain said object therebetween.

2 Claims, 3 Drawing Sheets

STRUCTURE OF FASTENING DEVICE FOR FASTENING TWO THINGS TOGETHER

BACKGROUND OF THE INVENTION

The present invention relates to fastening devices and relates more particularly to a fastening device for fastening a key chain to one'waist belt or clothes.

Key chain is a device commonly used holding a bunch of keys. When in use, people tend to attach a key chain to one's waist belt or clothes by a clip or clamp. FIG. 1 illustrates a known structure of key chain clip for fastening a key chain to one's waist belt or clothes. This structure is not satisfactory in use because the teeth of the clip may damage one's waist belt or clothes easily when it is in use. FIG. 1—1 illustrates a known structure of R-shaped clamp for fastening a key chain to one'waist belt or clothes. This structure is still not satisfactory in use due to weak clamping force.

SUMMARY OF THE INVENTION

The present invention has been accomplished to eliminate the aforesaid problems. According to the present invention, a fastening device is generally comprised of a curved clamping plate and a substantially Z-shaped strip spring. The curved clamping plate is made of an elongated resilient plate bent into shape, having an elongated slot longitudinally disposed at one end, a square recess spaced from said elongated slot and a hole disposed at an opposite end for holding a key chain. The Z-shaped strip spring has one end fixedly secured to the elongated slot through welding joint before the elongated, resilient plate is bent into shape, and an opposite end disposed adjacent to and spaced from the square recess of the curved clamping plate. By means of the spring force from the strip spring rubbing against the square recess of the curved clamping plate, the fastening device can be firmly secured to an object or used to firmly retain two objects together.

BRIEF DESCRIPTION OF THE DRAWINGS

FIG. 1—1 illustrates a known structure of R-shaped clamp for fastening a key chain to one's waist belt or clothes;

FIGS. 7 and 7-1 illustrate still another alternate form of the present invention.

DETAILED DESCRIPTION OF THE PREFERRED EMBODIMENT

A fastening device in accordance with he present invention is generally comprised of a curved clamping plate 1 having a substantially Z-shaped strip spring 2 incorporated thereto.

Figure 1:
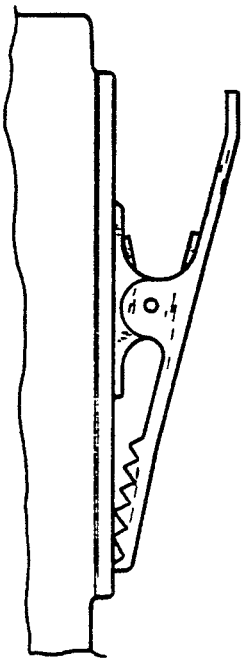
FIG. 1 illustrates a known structure of key chain clip for fastening a key chain to one'waist belt or clothes.
Figure 1:
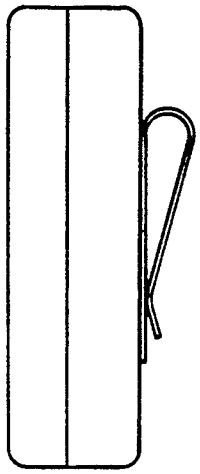
Figure 2:
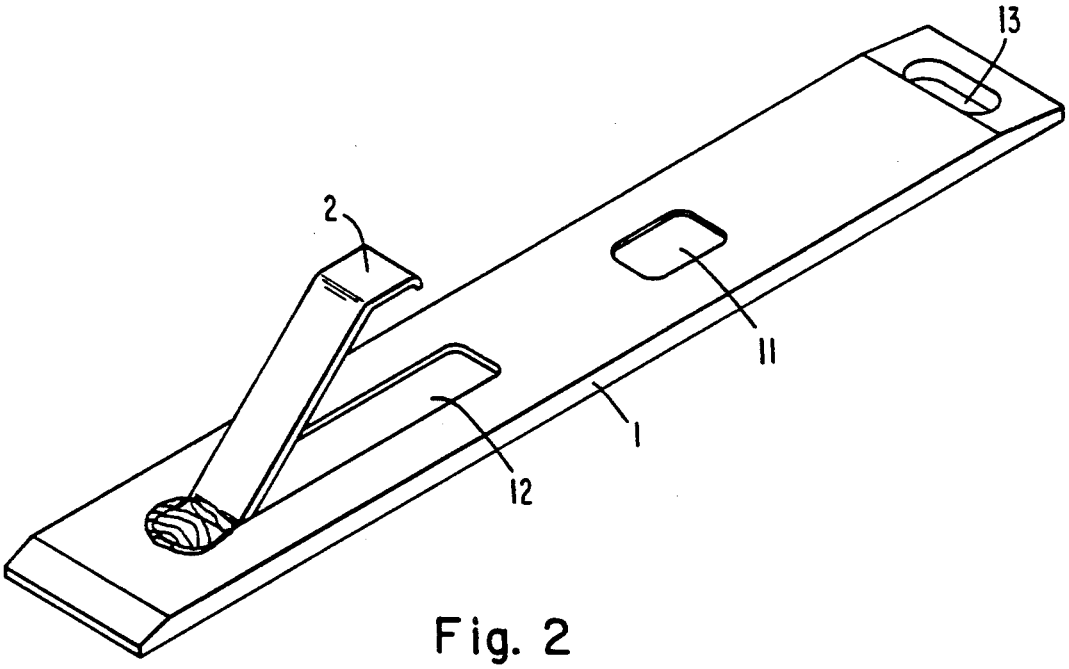
FIG. 2 is a perspective view of a fastening device according to the present invention before the curved clamping plate is bent into shape.
Figure 3:
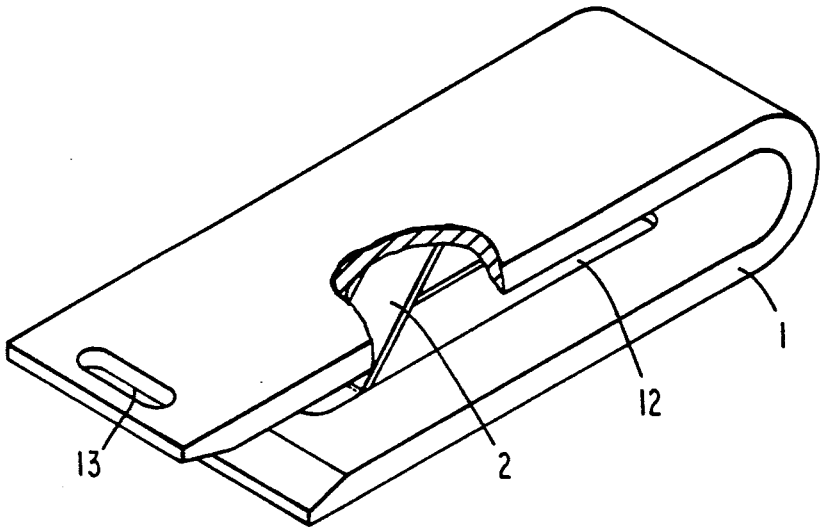
FIG. 3 is a perspective and partly cut off view of the fastening device of FIG. 2.
Figure 4:
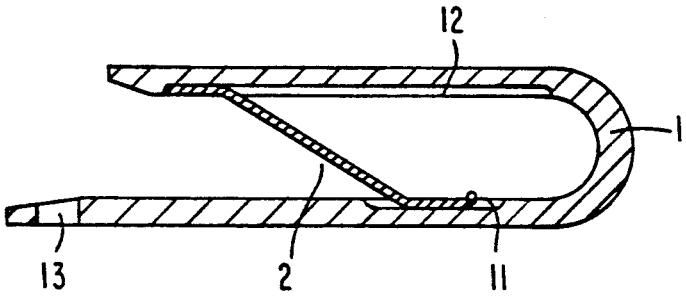
FIG. 4 is a sectional side view of the fastening device of FIG. 3.
Figure 5:
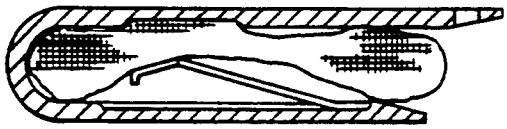
FIG. 5 illustrates an alternate form of the present invention for use as a tie clip.
Figure 6:
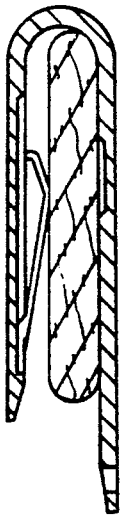
FIG. 6 illustrates another alternate form of the present invention for use as a money clip.
Figure 7:
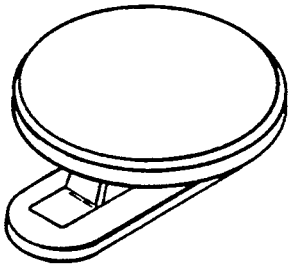
Figures 1, 7:
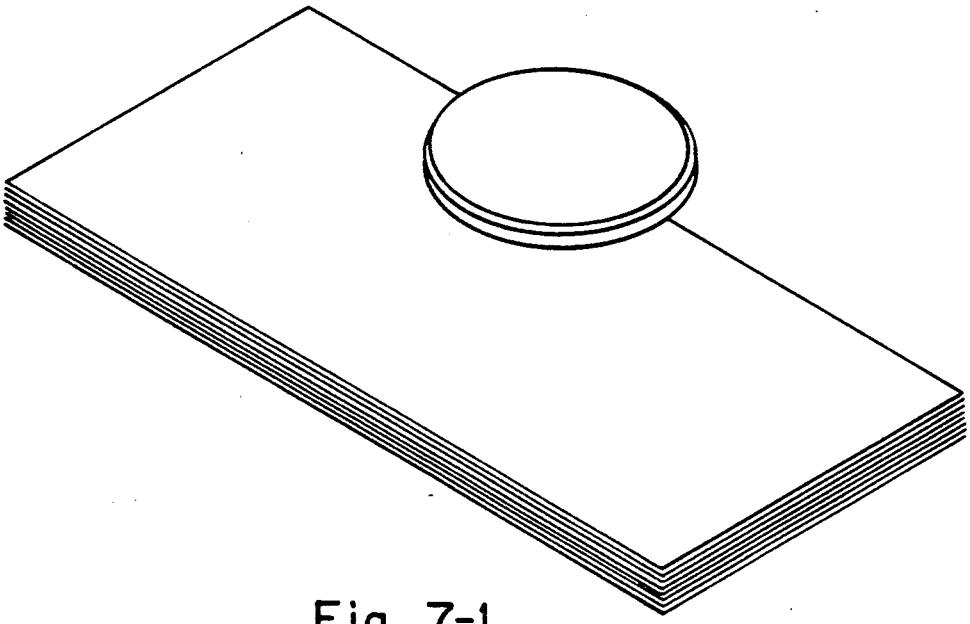

As illustrated in FIG. 2, the curved clamping plate 1 is bent into shape from a elongated, resilient plate which has a substantially Z-shaped strip spring 2 obliquely projecting therefrom at one end, an elongated slot 12 longitudinally extending from the connecting point between said Z-shaped strip spring 2, a hole 13 at an opposite end for fastening a key chain, and a square recess 11 on the same side relative to said Z-shaped strip spring 2 and at a location between said elongated slot 12 and said hole 13. The Z-shaped strip spring 2 of the curved clamping plate 1 is directly attached to the clamping plate 1 through welding joint before the curved clamping plate 1 is bent into shape.

When the curved clamping plate 1 is clamped on an object, the strip spring 2 is squeezed to produce a spring force against the square recess 11 so as to firmly retain said object therebetween.

The present invention may be made in any of a variety of shapes so as to use as a tie clip or a money clip.

What is claimed is:

1. A fastening device comprising a U-shaped clamping plate bent into shape from an elongated, resilient plate, and a substantially Z-shaped, elongated strip spring rectangular tab having a pair of members contained in parallel planes and a diagonally interconnecting spring plate connecting said tab members at adjacent ends, said U-shaped plate having an elongated slot longitudinally disposed along one leg, a square recess in the internal surface of an opposite leg disposed across from said elongated slot and a hole disposed at an opposite end of said opposite leg for holding a key chain, said Z-shaped strip spring having one tab welded to said U-shaped plate at an internal surface of the leg having said slot at the end of said slot adjacent the end of said leg and the opposite tab being normally received in the recess in the opposite leg of said U-shaped plate and wherein said strip spring is squeezed to produce a spring force, when said U-shaped plate is clamped to receive an object, urging said object against said square recess so as to firmly retain said object between said curved clamping plate and said strip spring.

2. A fastening device according to claim 1, wherein said device is shaped for use as a tie clip, money clip or any type of clip for fastening two things together.

* * * * *